US005816085A

United States Patent [19]

Winardi et al.

[11] Patent Number: 5,816,085

[45] Date of Patent: Oct. 6, 1998

[54] REMOTE ENTRY KNOBSET

[75] Inventors: Michael Winardi, Placentia; Edward J. Pilatowicz, Woodland Hills, both of Calif.

[73] Assignee: Emhart Inc., Newark, Del.

[21] Appl. No.: 841,099

[22] Filed: Apr. 29, 1997

[51] Int. Cl.[6] ..... E05B 47/06

[52] U.S. Cl. ..... 70/283; 70/278; 70/279; 70/473; 70/478; 292/169.15; 292/359

[58] Field of Search ..... 70/283, 279, 278, 70/277, 215, 216, 467, 469, 473, 475, 478, 479, 484, 485; 292/359, 169.14, 169.15

[56] References Cited

U.S. PATENT DOCUMENTS

| | | | |
|---|---|---|---|
| 2,998,273 | 8/1961 | Unetic | 292/169 |
| 4,148,092 | 4/1979 | Martin | 361/172 |
| 4,736,970 | 4/1988 | McGourty et al. | 292/359 |
| 5,000,018 | 3/1991 | Eisermann | 70/277 |
| 5,020,343 | 6/1991 | Hart et al. | 70/143 |
| 5,113,675 | 5/1992 | Uyeda | 70/477 |
| 5,386,713 | 2/1995 | Wilson | 70/280 |
| 5,475,996 | 12/1995 | Chen | 70/279 |
| 5,712,626 | 1/1998 | Andreou et al. | 340/825.31 |

*Primary Examiner*—Lloyd A. Gall
*Assistant Examiner*—Clifford B. Vaterlaus
*Attorney, Agent, or Firm*—Spencer T. Smith

[57] ABSTRACT

A knobset comprising a latch mechanism including an extendable deadbolt, a lock housing, a first spindle, a slide actuator, a slide housing mounted on the first spindle for supporting the slide actuator for linear displacement, spring means interconnecting the lock housing and the slide housing for establishing a neutral first spindle orientation, key operated means for displacing the slide actuator from a retracted position to an advanced position, the slide actuator having a notch therein, a locking slide including a detent portion spring biased in a selected direction to an advanced position whereat the detent portion is located within the slide actuator notch when the slide actuator is at the advanced position, means for preventing the displacement of the detent portion transverse to the selected direction, a blocking piece, and means for displacing the blocking piece from a retracted position whereat the detent portion is displaceable in the selected direction to an advanced position whereat the blocking piece prevents displacement of the detent portion in the selected direction, and means for preventing the displacement of the blocking piece by the locking slide in the selected direction when the blocking piece is at the advanced position.

3 Claims, 3 Drawing Sheets

REMOTE ENTRY KNOBSET

This invention relates to knobsets which can be locked on the outside by a key and locked on the inside by turning a turn button and more particularly to such a knobset which can also be opened when a receiver in the knobset receives a code from a remote transmitter.

BACKGROUND OF THE INVENTION

Rolling code technology has developed to the point that it is economically feasible to incorporate it into locks like car and house locks. With house locks, battery power is often the preferred energy source. This imposes severe limitations since the homeowner does not want to be replacing expensive batteries every month.

OBJECT OF THE INVENTION

It is accordingly an object of the present invention to provide a remote entry knobset which will use very little current in the remote entry mode.

Other objects and advantages of the present invention will become apparent from the following portion of this specification and from the accompanying drawings which illustrate in accordance with the mandate of the patent statutes a presently preferred embodiment incorporating the principles of the invention.

BRIEF DESCRIPTION OF THE PREFERRED EMBODIMENT

Figure 2:
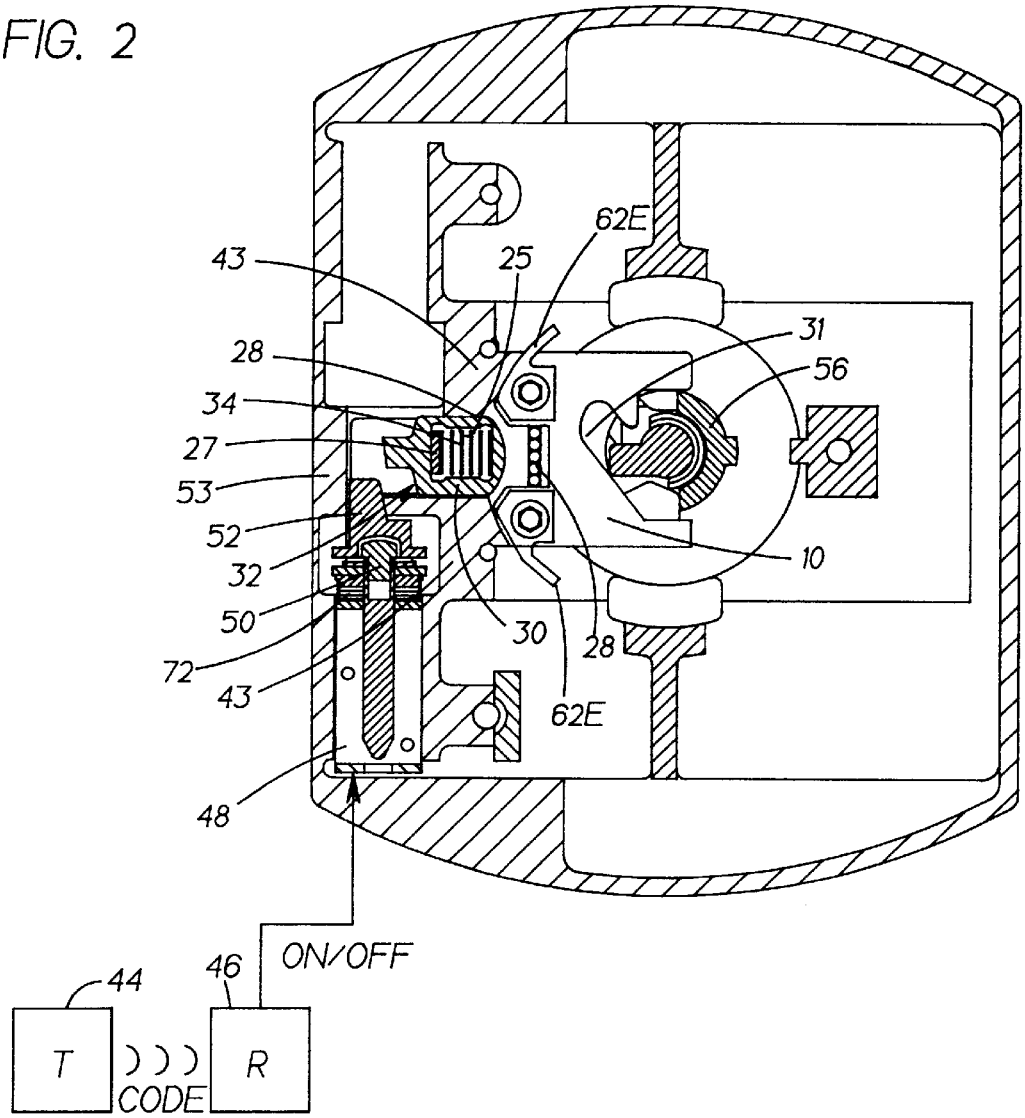
FIG. 2 is an axial view of a portion of the knobset shown in FIG. 1, in the door locked position.

A slide actuator 10, which is located within a slide actuator housing 12 (the top and bottom edges 13 of the slide actuator are located within bent over top and bottom flanges 15 of the slide actuator housing), has a follower surface 14 which is displaced by a cam ramp 16 on a round spindle 18. A cross link 20, formed at one end of the round spindle, cooperates with pins 22 defined in the open end of a lock plug 24, so that when a key 26 is put in the plug and rotated to lock the door, the plug pins will engage the cross link 20 and rotate the round spindle 18 thereby displacing the slide actuator 10 to a door locked position where the concave end 28 of the slide actuator captures the detent portion 30 of a locking slide 32 (FIG. 2). A compression spring 34 which is located within a pocket 25 within the detent portion, extends between an upstanding support 27 of a spring stop member 29 which is secured to the base 42 of the lock housing 36 and the front end wall 31 of the detent portion pocket, continuously urges the locking slide to this door locked position.

Figure 1:
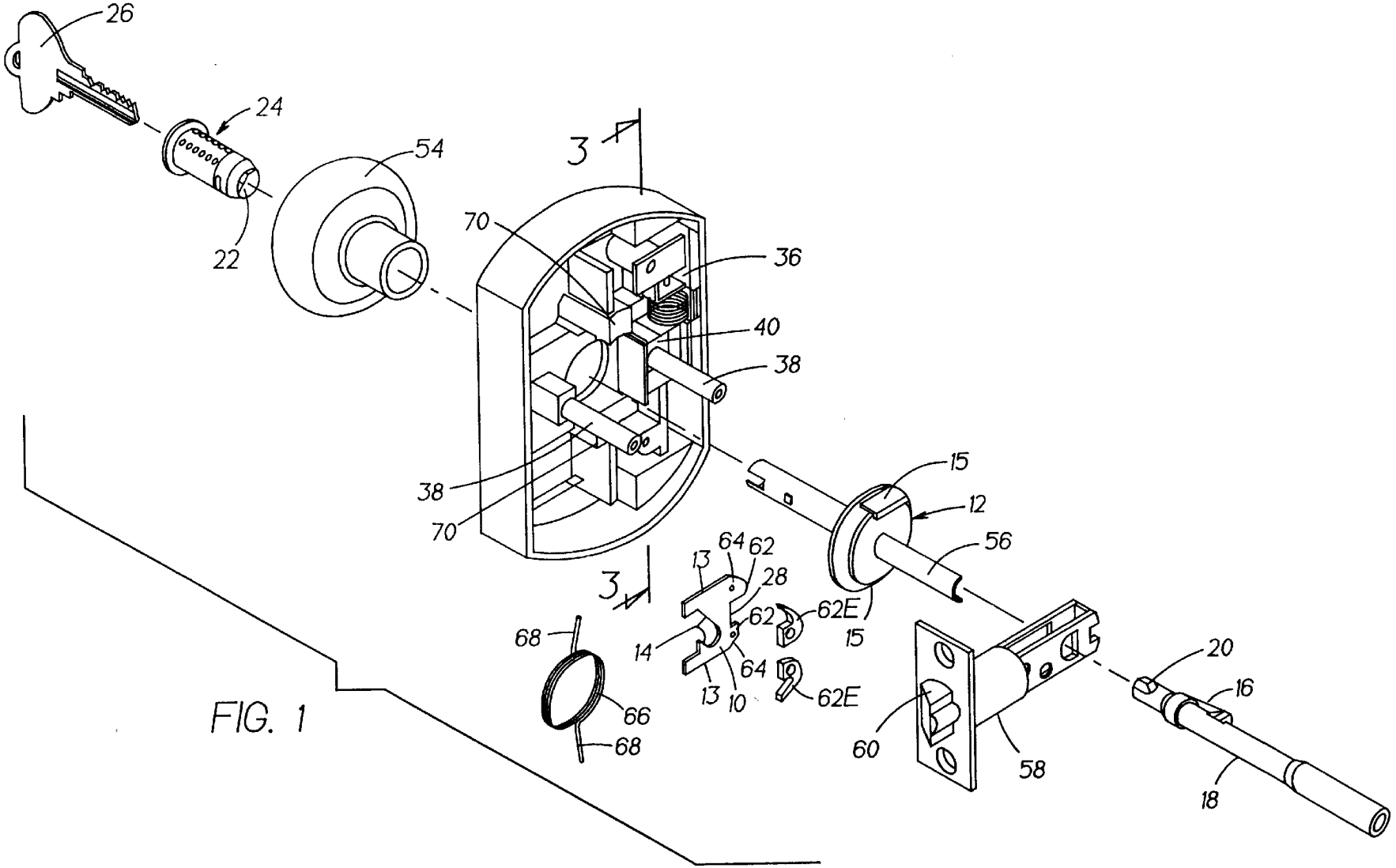
FIG. 1 is an exploded perspective view of a portion of a knobset made in accordance with the teachings of the present invention.
Figure 3:
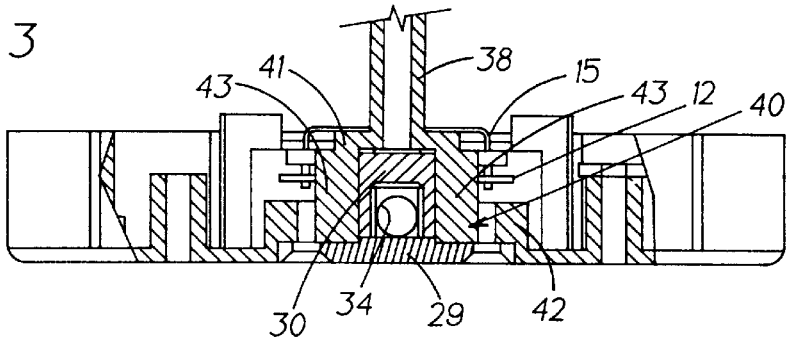
FIG. 3 is a view taken at 3—3 of FIG. 1.
Figure 4:
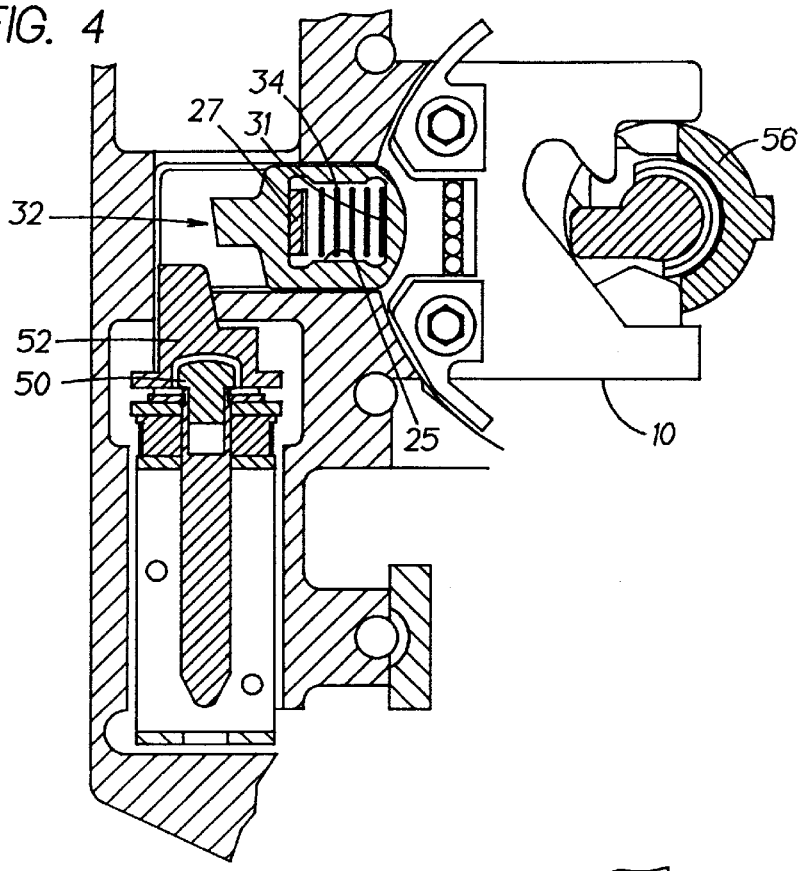
FIG. 4 is an axial view of the portion of the knobset shown in FIG. 2, when the door has been unlocked with the use of a remote transmitter.
Figure 5:
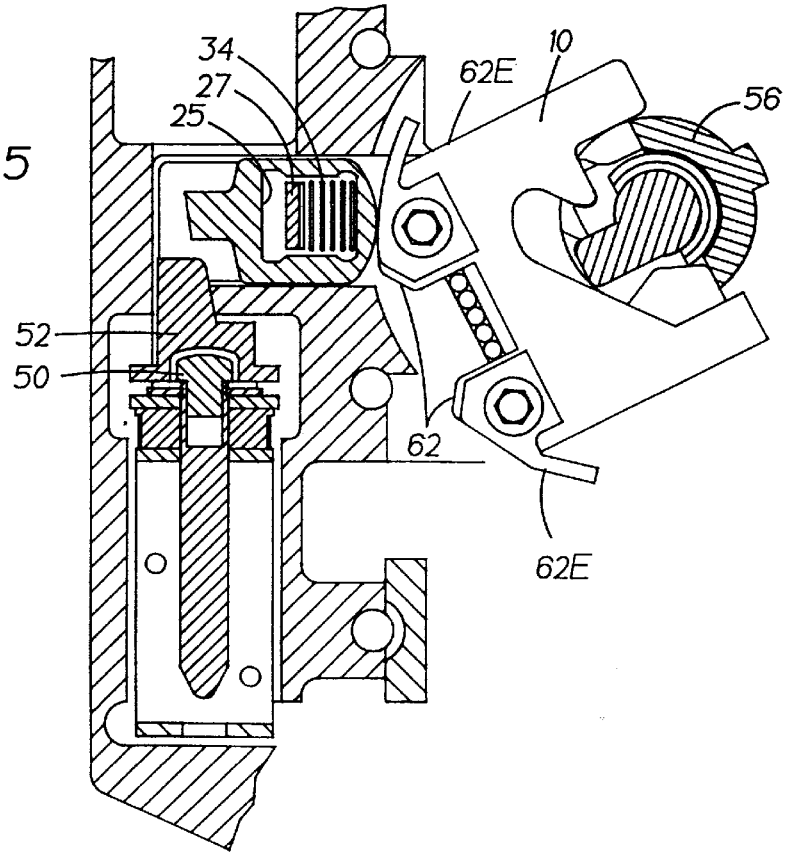
FIG. 5 is an axial view of the portion of the knobset shown in FIG. 3, when the external knob has been rotated.

As can be seen from FIGS. 1 and 3, one of the threaded posts 38 of the lock housing is integral with a bridge 40 which has a top 41 and opposed sides 43 which is part of the base 42 of the lock housing 36. This bridge is configured to capture the detent portion 30 of the locking slide and constrain it to linear movement between the door locked position (FIG. 2) and the door released position (FIGS. 4 and 5).

When a transmitter T 44 transmits the correct code, a receiver R 46 will supply an "on" signal to a solenoid 48. The normally advanced pin 50 of the solenoid which is biased towards the blocking position by compression spring 72 will be retracted from its advanced position (FIG. 2) to its retracted position (FIGS. 4 and 5) and as a consequence, the blocking piece 52, which is secured to the end of the solenoid pin 50, which at the advanced position, blocks the displacement of the locking slide (a portion 53 of the lock housing wall acts as a physical stop to movement of the blocking piece 52 by the locking slide), will move to a retracted position clear of the locking slide. Now the exterior operator (knob) 54, which rotates with the half round 56 to operate the latch 58 to pull the bolt 60, can be rotated to unlock the door (the rounded surface 62 of one of the end projections 64 of the slide actuator engages and cams the detent portion 30 of the locking slide rearwardly out of the way). The rounded surfaces 62 are extended by surface extenders 62E which are secured to the slide actuator. As soon as the knob is released, a detent spring 66 will return the knob to its neutral position (the bent ends 68 of the spring engage housing posts 70). The compression spring will return the locking slide to its advanced position and the solenoid, after a timed interval, will turn off thereby allowing the blocking piece to return to its advanced blocking position. The door can also be opened conventionally by turning the key, and hence the round spindle 18 to retract the slide actuator 10 away from the detent portion. Further details of the conventional portion of this knobset are disclosed in U.S. Pat. No. 5,335,950.

We claim:

1. A knobset comprising a latch mechanism including an extendable deadbolt, a lock housing, a first spindle mounted on said lock housing for rotatable displacement, a slide actuator, a slide actuator housing mounted on said first spindle for supporting said slide actuator for linear displacement relative to said slide actuator housing, spring means for establishing a neutral first spindle orientation, key operated means for linearly displacing said slide actuator from a retracted position to an advanced position, said slide actuator having a notch therein, a locking slide including a detent portion spring biased in a selected direction to an advanced position whereat said detent portion is located within said slide actuator notch when said first spindle has said first orientation with said slide actuator at said advanced position, means for preventing the displacement of said detent portion transverse to said selected direction, a blocking piece, and means for displacing said blocking piece between a retracted position whereat said detent portion is displaceable in a direction opposite said selected direction and an advanced position whereat said blocking piece prevents displacement of said detent portion in said opposite direction, and means for preventing the displacement of said blocking piece by said locking slide in said opposite direction when said blocking piece is at said advanced position.

2. A knobset according to claim 1, wherein said means for displacing said blocking piece between a retracted position and an advanced position comprises a solenoid including a displaceable pin connected to said blocking piece for displacing said blocking piece from said advanced position to said retracted position when operated and a spring for urging said pin toward said advanced position.

3. A knobset according to claim 2, wherein said means for displacing said blocking piece between a retracted position and an advanced position further comprises a receiver for supplying said solenoid with an "on" signal when a selected code is received so that said solenoid will retract said blocking piece against the action of said spring, and a transmitter for transmitting said selected code to said receiver.

* * * * *